United States Patent [19]

Herridge

[11] Patent Number: 4,880,247

[45] Date of Patent: Nov. 14, 1989

[54] CUTTING TOOLS

[75] Inventor: Frederick J. Herridge, Buckinghamshire, England

[73] Assignee: Anderson Strathclyde PLC, High Wyconbe, England

[21] Appl. No.: 202,300

[22] Filed: Jun. 6, 1988

[30] Foreign Application Priority Data

Jun. 6, 1987 [GB] United Kingdom ..... 8713298

[51] Int. Cl.[4] ..... E21C 25/46

[52] U.S. Cl. ..... 279/79; 299/92

[58] Field of Search ..... 279/1 B, 1 Q, 15 G, 279/22, 23 R, 24, 29, 30, 76, 79, 87, 89, 93, 97, 105; 299/92

[56] References Cited

U.S. PATENT DOCUMENTS

| | | | |
|---|---|---|---|
| 3,063,691 | 11/1962 | Osgood | 279/79 |
| 3,092,374 | 6/1963 | Krekeler | 279/79 |
| 3,254,922 | 6/1966 | Krekeler | 279/79 |
| 3,526,435 | 9/1970 | Krekeler | 299/92 |
| 4,274,678 | 6/1981 | Herridge | 299/92 |

FOREIGN PATENT DOCUMENTS

| | | | |
|---|---|---|---|
| 855279 | 11/1960 | United Kingdom . | |
| 895764 | 5/1962 | United Kingdom . | |
| 961239 | 6/1964 | United Kingdom . | |
| 999432 | 7/1965 | United Kingdom . | |
| 1059087 | 2/1967 | United Kingdom | 299/92 |
| 1062752 | 3/1967 | United Kingdom . | |
| 1092277 | 11/1967 | United Kingdom | 299/92 |
| 1100015 | 1/1968 | United Kingdom . | |
| 1107371 | 3/1968 | United Kingdom . | |
| 1167714 | 10/1969 | United Kingdom . | |
| 1255491 | 12/1971 | United Kingdom . | |
| 1258523 | 12/1971 | United Kingdom . | |
| 1315713 | 5/1973 | United Kingdom . | |
| 1373655 | 11/1974 | United Kingdom . | |
| 1549046 | 7/1979 | United Kingdom . | |

*Primary Examiner*—Gil Weidenfeld
*Assistant Examiner*—Daniel W. Howell
*Attorney, Agent, or Firm*—Fleit, Jacobson, Cohn, Price, Holman & Stern

[57] ABSTRACT

A combination of a cutting tool (10) and a holder (14) defining a socket (13) for receiving a shank (12) of the cutting tool, wherein the shank includes a slot (17) extending transversely to its longitudinal axis, an elongate locking bar (20) mounted in the slot and projecting therefrom, and resilient means (19) biassing the bar into its projecting position and wherein the holder includes an elongate abutment member 21 releasably connected thereto and co-operable with the locking bar to retain the shank within the socket.

12 Claims, 4 Drawing Sheets

CUTTING TOOLS

This invention relates to cutting tools and holders therefor and particularly but not exclusively to cutting tools and holders for use in cutting minerals, e.g., in coal mining.

It is important that a cutting tool is retained securely in its holder, while being releasable therefrom for replacement. For this purpose, a wide variety of retaining means has been proposed, only some of which have been successful in practice. In one successful arrangement, the retaining means comprises a resiliently mounted latch carried by the tool shank as described in UK Patent Specification No. 1062752. In another successful arrangement, the retaining means comprises a resiliently mounted latch carried by the tool holder as described in UK Patent Specification No 1373655.

It is an object of the present invention to provide a simple and effective tool retaining means which permits quick release of the tool from its holder.

The invention provides a combination of a cutting tool and a holder defining a socket for receiving a shank of the cutting tool, wherein the shank includes a slot extending transversely to its longitudinal axis, an elongate locking bar mounted in the slot and projecting therefrom, and resilient means biassing the bar into its projecting position and wherein the holder includes an elongate abutment member releasably connected thereto and co-operable with the locking bar to retain the shank within the socket.

Preferably the slot extends across substantially the whole width of a substantially flat face of the shank. Preferably the resilient means comprises a resilient block of elastomeric material disposed between the bar and the base of the slot such that movement of the bar towards the axis of the shank is opposed by resilience of the block. The block which may for example be of neoprene may be bonded to the bar.

The bar and resilient means can thus occupy substantially the whole volume of the slot to prevent entry of fines from cut material which might impede movement of the bar.

In a preferred form of the invention, the shank is of rectangular cross-section and the slot extends across a face of the shank which is rearmost relative to the cutting direction.

The bar may be of solid metal such as steel. Alternatively the bar may comprise a spring pin in the form of a tube having a longitudinally extending slit providing a degree of resilience under radial load. The block may be moulded so as to infill the tube and extend through the slit such that the bar and block are keyed together.

Preferably the abutment member comprises a pin extending transversely to the longitudinal axis of the socket and parallel to the locking bar. The pin may be a solid metal pin or alternatively may be in the form of a spring pin having radial resilience.

Preferably the pin is connected to the holder by location in a through hole of the holder thereby facilitating removal of the pin by axial movement thereof. Where the pin is a spring pin, the resilience of the pin ensures that the pin is a tight fit within the hole where a slightly undersized hole is used thereby ensuring that the pin is firmly retained and allowing manufacture to less stringent tolerance in respect of the hole diameter.

The pin may therefore be arranged to form an abutment member in which only part of the cross-section of the pin extends into the socket and conveniently the pin is mounted with each of its end portions located in a through hole of the holder.

Advantageously the relative positions of the abutment member and the locking bar are such that removal of the shank from the socket is accompanied by progressive deflection of the bar against the bias of the resilient means thereby urging the shank back into the socket. This can be achieved for example by positioning the bar and the pin such that in the normal fully inserted position of the shank the bar and pin are engaged in line contact along their respective cylindrical surfaces with the line joining their respective axes subtending an angle of about 45° to the longitudinal axis of the shank. As the shank is pulled out of the socket this angle will increase accompanied by movement of the locking bar towards the shank axis against the resilience of the block.

As indicated above, the abutment member preferably comprises a pin mounted with each of its end portions in a through hole in the holder. The through hole can be of small diameter so as to avoid undesirable weakening of the holder and the pin can be readily driven out of the holder for replacement or to release a damaged tool, where for example the tool shears off at a location near the head of the shank such that the remaining stub of the shank cannot readily be extracted.

The following is a description, which is given by way of example only, of embodiments of the invention. Reference is made to the accompanying schematic drawings, in which.

Figure 1:
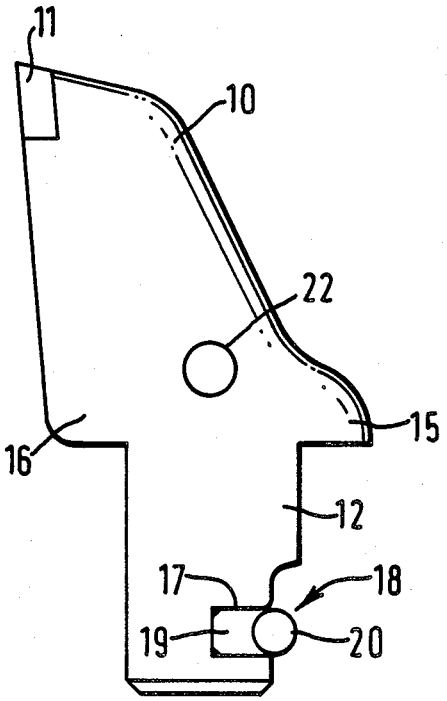
FIG. 1 is a side view of one embodiment of a coal cutting tool in accordance with the invention.
Figure 2:
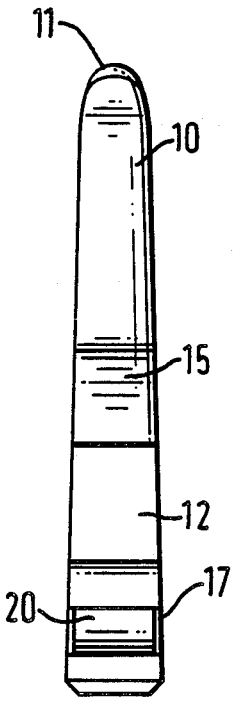
FIG. 2 is a rear view of the tool of FIG. 1.
Figure 3:
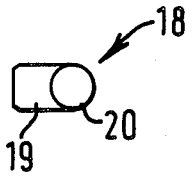
FIG. 3 is a side view of the locking bar and resilient means used in the tool of FIG. 1.
Figure 4:
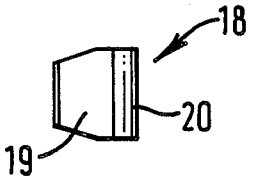
FIG. 4 is a plan view of the locking bar and resilient means of FIG. 3.

The tool shown in the drawings has a blade 10 provided with a cutting tip 11 and a shank 12 of rectangular cross-section. In use, the shank 12 fits into a socket 13 in a holder 14, and a heel 15 and toe 16 on the blade 10 abut the top of the holder.

Referring now to the tool of FIG. 1, adjacent to its base, i.e., its lower end as viewed in the drawings, the shank 12 is provided with a slot 17 extending transversely with respect to both the axis of the shank and to the cutting direction and opening through the face of the shank which is rearmost relative to the cutting direction. The slot 17, which is of rectangular cross-section, extends across the whole width of the rear face of the shank so that the slot opens, at its ends, through the side faces of the shank. A locking member 18 is disposed in the slot 17. The locking member comprises a block 19 of neoprene which is bonded to a steel locking bar 20 of circular cross-section. The block 19 is a close fit in, and may be bonded in, the slot and the locking bar 20 protrudes, over about half its circumference, from the rear face of the shank. The diameter of the bar is slightly less than the width of the slot so that under pressure it can move into the slot against the resilient action of the block 19. The block 19 and the bar 20 extend for substantially the whole length of the slot so as substantially to fill the slot.

The holder 14 is drilled through from side to side to provide a through hole which accommodates a steel retaining pin 21 of circular cross-section which extends across and projects partly into the socket 13 from the rearmost face thereof.

Figure 8:
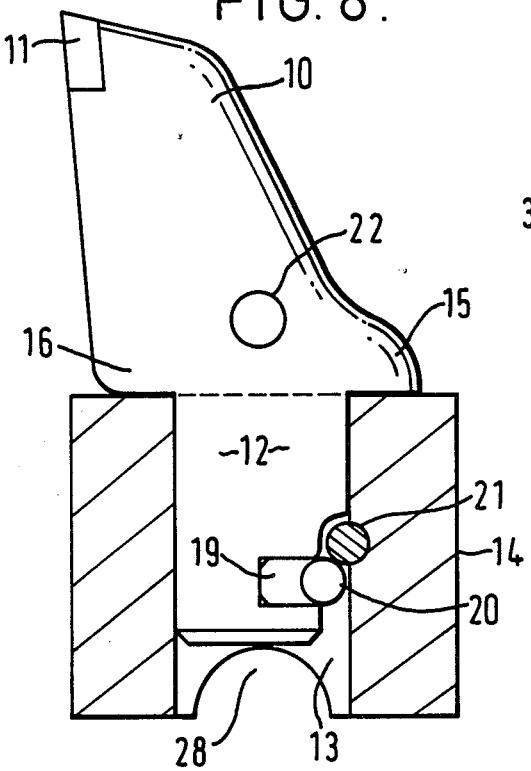
FIG. 8 is a side view of the tool of FIG. 1 mounted in the holder of FIG. 5, the holder being shown in section.

When the tool is being inserted into the holder, the locking bar 20 engages the retaining pin 21 and is thus urged into the slot so that the bar passes the retaining pin and the shank 12 is inserted fully into the socket 13. When the shank has been fully inserted, the tool is securely retained in the holder by contact of the locking bar 20 with the underside of the retaining pin 21, as shown in FIG. 8. The relative location of the locking bar and retaining pin when the tool is in the holder is such that there is a net residual force from the block 19 pulling the tool into the holder.

Figure 5:
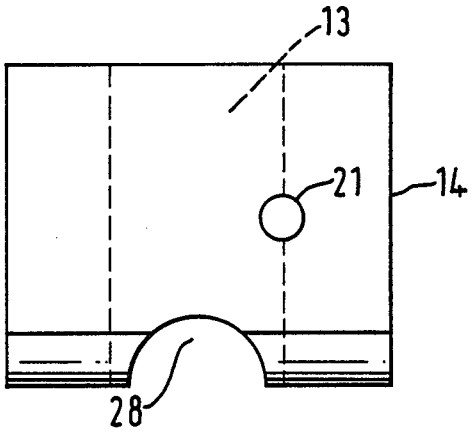
FIG. 5 is a side view of one embodiment of tool holder in accordance with the invention for use with the tool of FIG. 1.
Figure 6:
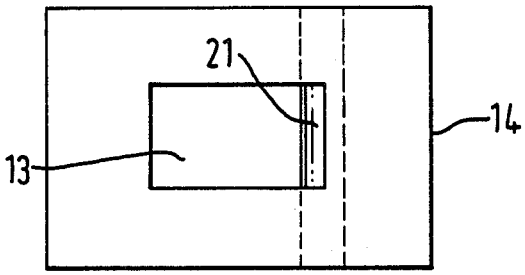
FIG. 6 is a plan view of the holder of FIG. 5.
Figure 7:
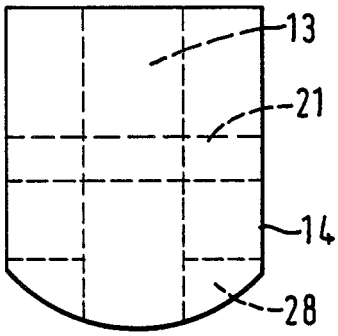
FIG. 7 is an end view of the holder of FIG. 5.

As can be seen in FIGS. 1 and 8 the lower part of the rear of the shank 12 above and below the slot 17 is cut away. This reduction in dimensions is necessary to permit of insertion of the shank into the socket and deflection of the locking bar 20 by the retaining pin 21. However, the upper part of the shank is still dimensioned so as to be, on all sides, a close sliding fit in the socket, as is necessary to give proper support to the tool. A through hole 22 is provided in the blade 10 of the tool for receiving an extractor for removing the tool from the holder in known manner. In known manner, the holder has an arcuate through aperture 28 in its base to permit a chisel to be driven in to free the shank 12 from the holder 14. For simplicity of illustration, this aperture is shown only in FIGS. 5 and 7.

In FIGS. 1 to 8, the locking bar 20 and the retaining pin 21 are shown as having circular cross-sections and the socket 13 in the holder 14 is shown as having a rectangular cross-section. Other cross-sections may of course be used.

Figure 9:
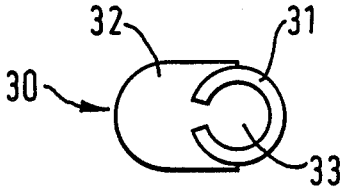
FIG. 9 is a cross-sectional view of an alternative locking bar and block assembly including a spring pin.

In FIG. 9 an alternative locking bar 31 is shown assembled with a neoprene block 32 together forming an alternative locking member 30. The bar 31 is a spring pin in the form of a slit cylindrical tube and is bonded to the block 32 such that the neoprene material of the block extends into and fills the interior 33 of the bar 31. The bar 31 and block 32 are thereby keyed together.

Figure 11:
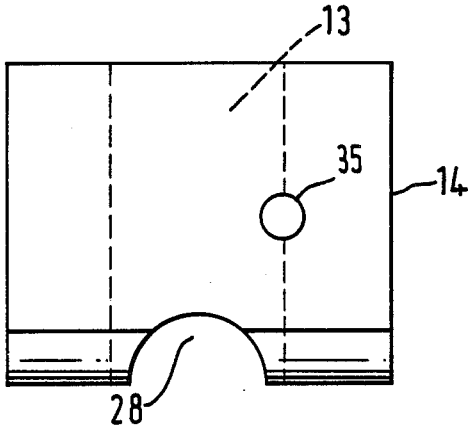
FIG. 11 is a side view of an alternative embodiment of retaining pin for the tool holder for use with the tool of FIG. 1.

In an alternative arrangement a similar type of spring pin 35 illustrated in FIG. 11 may be used as a retaining pin in place of the solid pin 21 described in the previous embodiment.

Figure 10:
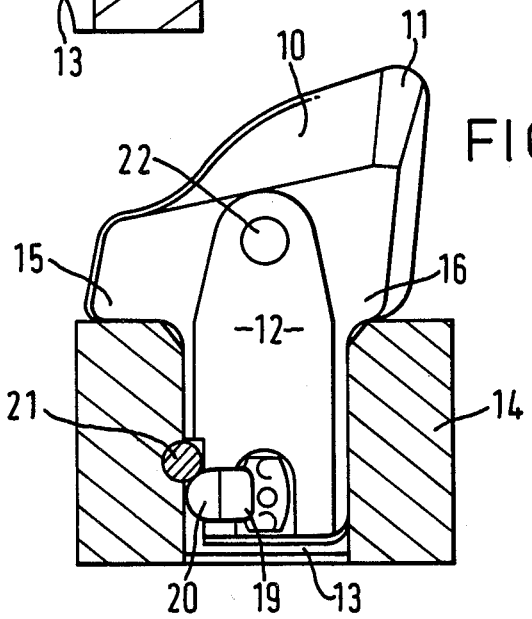
FIG. 10 is a sectional view of an alternative tool and holder.

In FIG. 10 an alternative tool and holder are shown using corresponding reference numerals to those of FIGS. 1 to 8. The shank 12 is shown in its fully inserted position in which the heel 15 is positively biassed into contact with the holder 14 by action of the resilient block 19.

The tool and the holder described above with reference to the accompanying drawings combine the following important advantages:

The movable part of the locking device (and therefore the part most likely to deteriorate) is mounted in the shank of the tool, so that a new locking device is inserted with each new tool. This avoids the problem that if the movable part of the locking device is mounted in the holder, it will deteriorate after a number of tools have been inserted and removed.

The slot which receives the locking bar is located in a part of the shank which is lightly stressed and therefore accommodation of the bar does not weaken the tool undesirably.

The provision of a retaining pin in the holder requires only small holes to be drilled in the holder box. Therefore, the provision of the retaining pin does not result in a substantial reduction of the cross-sectional area of the body of the holder with consequent loss of strength.

The above features result in an exceptionally strong combination of pick and box i.e. tool and holder.

The retaining pin is also easily removed and replaced if damaged and is inexpensive. If the blade breaks off the shank, the shank can easily be removed from the holder after the retaining pin has been removed by knocking it through the holder.

As previously explained, the locking bar and retaining pin can be so arranged that the tool, when in position in the holder, is pulled into it.

The locking bar and retaining pin permit easy extraction of the tool for replacement.

The fit of the tool in the holder and the absence of any open orifices in the holder which are exposed in use prevent the ingress of fines and therefore minimise the risk of the tool becoming jammed in the box.

I claim:

1. A combination of a cutting tool and a holder defining a socket for receiving a shank of the cutting tool, wherein the shank includes a slot extending transversely to its longitudinal axis, an elongate locking bar mounted in the slot and projecting therefrom, and resilient means biassing the bar into its projecting position and wherein the holder includes an elongate abutment member releasably connected thereto and co-operable with the locking bar to retain the shank within the socket.

2. A combination tool and holder as claimed in claim 1 wherein the slot extends across substantially the whole width of a substantially flat face of the shank.

3. A combination tool and holder as claimed in claim 2 wherein the resilient means comprises a resilient block of elastomeric material disposed between the bar and the base of the slot such that movement of the bar towards the axis of the shank is opposed by resilience of the boock.

4. A combination tool and holder as claimed in claim 3 wherein the bar is bonded to the block.

5. A combination tool and holder as claimed in claim 3 wherein the bar and the block extend substantially the full length of the slot.

6. A combination tool and holder as claimed in claim 1 wherein the shank is of substantially rectangular cross-section and the slot extends across a face of the shank which is rearmost relative to the cutting direction of the tool.

7. A combination tool and holder as claimed in claim 1 wherein the bar comprises a spring pin having radial resilience.

8. A combination tool and holder as claimed in claim 1 wherein the abutment member comprises a pin extending transversely to the longitudinal axis of the socket and parallel to the locking bar.

9. A combination tool and holder as claimed in claim 8 wherein the pin is a spring pin having radial resilience.

10. A combination tool and holder as claimed in claim 8 wherein the pin is connected to the holder by location in a through hole of the holder facilitating removal of the pin by axial movement thereof.

11. A combination tool and holder as claimed in claim 10 wherein the relative positions of the abutment member and the locking bar are such that removal of the shank from the socket is accompanied by progressive deflection of the bar against the bias of the resilient means thereby urging the shank back into the socket.

12. A combination tool and holder as claimed in claim 11 wherein the relative positions of the abutment member and the locking bar are such that in the fully inserted position of the shank, the bar is deflected from its fully projecting position against the bias of the resilient means to thereby urge the shank into the socket so as to positively seat the tool in the holder.

* * * * *